US006073694A

United States Patent [19]

Crawshaw

[11] Patent Number: 6,073,694

[45] Date of Patent: Jun. 13, 2000

[54] PLUG PLACEMENT METHOD

[75] Inventor: John Peter Crawshaw, Newmarket, United Kingdom

[73] Assignee: Schlumberger Technology Corporation, Sugar Land, Tex.

[21] Appl. No.: 09/082,390

[22] Filed: May 20, 1998

[30] Foreign Application Priority Data

May 24, 1997 [GB] United Kingdom ..... 9710672

[51] Int. Cl.[7] ..... E21B 33/10

[52] U.S. Cl. ..... 166/292; 166/285

[58] Field of Search ..... 166/285, 289–292, 166/294, 295

[56] References Cited

U.S. PATENT DOCUMENTS

| | | | |
|---|---|---|---|
| 3,447,608 | 6/1969 | Fry et al. | 166/294 |
| 3,831,383 | 8/1974 | Crank | 166/295 |
| 4,275,788 | 6/1981 | Sweatman . | |
| 4,339,000 | 7/1982 | Cronmiller | 166/295 |
| 4,917,185 | 4/1990 | Jennings, Jr. et al. | 166/281 |
| 5,368,103 | 11/1994 | Heathman et al. | 166/289 |

FOREIGN PATENT DOCUMENTS

| | | |
|---|---|---|
| 94/28085 | 7/1994 | WIPO . |

*Primary Examiner*—Eileen Dunn Lillis
*Assistant Examiner*—Sunil Singh
*Attorney, Agent, or Firm*—Gordon G. Waggett; Robin C. Nava

[57] ABSTRACT

A method for placing a plug at a predetermined location in a wellbore, the method being based on utilising a supporting fluid solidifying after being subjected to shear forces. After placing the supporting fluid and allowing it to develop sufficient strength, the plug material is injected. A preferred example of the fluid is an emulsion comprising polymer material and crosslinking agent separated by phase boundaries prior to the shearing process.

5 Claims, 2 Drawing Sheets

FIG. 2A(Prior Art)
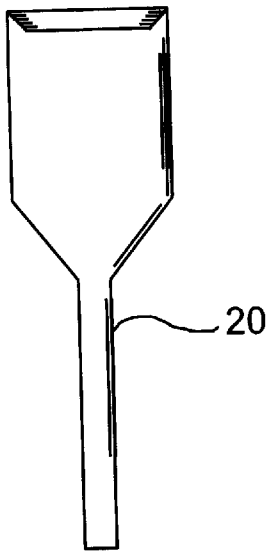
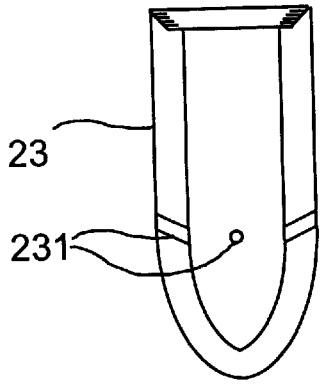
FIG. 2C
(Prior Art)
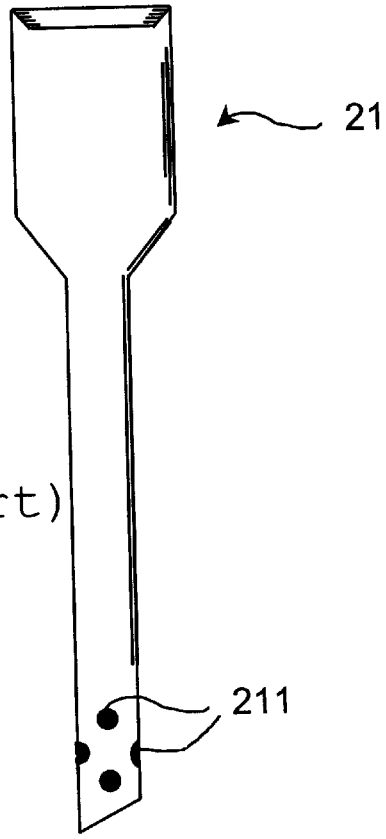
FIG. 2B
(Prior Art)

PLUG PLACEMENT METHOD

The present invention relates to methods and materials for placing a permanent plug in a wellbore. More specifically, it relates to plug placement methods which include the step of injecting a chemical compound of high viscosity below the planned depth of the plug.

BACKGROUND OF THE INVENTION

Plugging an oil well is a common cementing operation practised for a variety of reasons, for example, to sidetrack above a fish (equipment lost in the hole), to initiate directional drilling in a weak formation, to plug back a zone or a complete well for abandonment, to cure a lost circulation problem encountered during drilling, or to provide a test anchor when a weak formation exists in an open hole below the zone to be tested.

In all these cases the cement plug is often required to fill a zone at a depth considerably above the bottom of the well, so a deep "rathole" exists below the cemented interval. In these circumstances problems are frequently encountered and several attempts may be required to achieve a successful plug. One important reason for this is that the cement is often considerably denser than the drilling fluid initially in the wellbore. In this situation the cement plug is unstable and it can fall through the drilling fluid, contaminating the cement and resulting in a failed plug.

Several methods have been proposed in the past for supporting cement plugs, none of them gave entirely satisfactory results. In an article by R. C. Smith et al, Journal of Petroleum Technology, November 1984, 1897–1904, the setting of a viscous pill below the desired location of the bottom of the cement (BOC) is suggested. The pill can be made by adding a viscosifier such as bentonite to the existing mud system or by formulating a viscous spacer using, for example, MUDPUSH XL (Trademark of Schlumberger Dowell). However, experimental work has shown that this approach is not always reliable and that the cement can still channel through the viscous pill.

An alternative to the viscous pill is the reactive viscous pill (RVP) which contains an additional component which reacts with either the drilling fluid initially filling the well or any cement which starts to fall through the pill. Examples of the RVP method are described by D. L. Bour et al. SPE 15008 (1986), 187–193. The reactive component is usually sodium silicate which reacts with calcium ions to form a stiff gel. This method relies on good mixing between the RVP and the cement or drilling fluid and this is difficult to achieve in such a way that the gelled region extends across the entire cross-section of the wellbore. Indeed, the placement procedure conventionally employed minimises mixing during placement and it is claimed that the reaction is initiated by the cement falling through the RVP material.

It is therefore an object of the invention to improve the known methods used for placing a plug in a wellbore so as to prevent failure of the plug. It is a more specific object of the invention to improve the viscous pill method such that the resulting pill has improved gel strength properties.

Furthermore of interest with regard to the present invention, are fluids which form a stiff gel, without the need for mixing with a second fluid downhole. These fluids are used in fields of the oil industry, for example for lost circulation or conformance control. Most of these fluids gel due to a reaction initiated at the time they are mixed on surface and have only a fixed time (usually strongly dependent on temperature) after mixing during which they can be placed in the appropriate place in the wellbore.

One class of these fluids thickens due to a chemical reaction initiated by subjecting them to a high shear stress. This shear may be provided by a nozzle at the end of the drill pipe used to place the fluids in the wellbore. U.S. Pat. No 4,663,366 discloses an emulsion wherein the oil phase contains a water swelling hydrophilic clay such as bentonite which is initially kept separate from the water phase by a membrane or film of polymeric material. This membrane is formed by a polyamine derivative dispersed in the oil phase and a polyacrylamide and a polycarboxylic acid dissolved in the water phase. When the emulsion is subjected to high shear forces the membrane is ruptured and the bentonite is brought into contact with the water at which time it swells and thickens the liquid.

International Patent Application number WO 94/28085 discloses an alternative fluid consisting of an emulsion of a continuous oil phase containing an emulsifier and a crosslinking agent for a polysaccharide and a water discontinuous phase containing a polysaccharide. When this liquid is subjected to high shear the emulsion is broken causing the polysaccharide to crosslink and form a gel which is much stronger than that of U.S. Pat. No. 4,663,366. The proposed use for the fluid of Int. Pat. WO 94/28085 was for preventing "lost circulation" or leakage of fluids from the wellbore into the formation and the material was intended to migrate into the formation and then rapidly set, thus preventing further losses of fluid from the wellbore.

SUMMARY OF THE INVENTION

The objects of the invention are achieved by methods and apparatus as set forth in the appended independent claims.

One aspect of the invention is a method for setting a permanent plug, preferably a cement plug, in a wellbore whereby the dense permanent plug is supported above a less dense (drilling) fluid by a third material until the permanent plug has hardened and become self supporting. This is accomplished by placing a special fluid pill below the intended location of the cement plug. At a given time after the placement of the fluid pill in the wellbore, i.e. the setting time of the fluid pill, it undergoes a reaction altering its physical characteristics from those of an easily pumped liquid into a tough elastic solid, strong enough to support a dense cement above a less dense drilling fluid.

It is particularly advantageous that the reaction is initiated by high shear at a predetermined position in placement pipe, for example at the lower end or at some higher location. In contrast to other methods the proposed technique does not require good mixing with another fluid downhole and it is not adversely affected by delays between mixing on the surface and placement.

It is important that the density of the fluid pill is matched to that of the fluid initially in the wellbore so that it remains static between placement and gellation and this is accomplished by weighting the fluid with a dense, particulate solids such as Barite. After the fluid has set, the material for the permanent plug, e.g., cement, is injected at a position in the wellbore just above the top of the gelled material which then acts as a support or bridge for the denser plug material.

The gel strength which can be achieved by the reaction after placement is well above that of a pumpable fluid which does not react downhole. The gel strength of the material once set is preferably above 500 Pa, more preferably above 1000 Pa, and most preferably in a range between 2000 to 10000 Pa or even 15000 Pa.

Additionally, the fluid will conform to the irregular shape of the wellbore before it sets allowing its use in unconsolidated or "out of gauge" sections of the well where mechanical devices such as inflatable packers are of limited use.

Preferred materials for use in the inventive method are emulsion type compounds which destabilise under shear forces. Examples of such materials are known from the above cited patent documents WO 94/28085 and U.S. Pat. No. 4,663,366.

These and other features of the invention, preferred embodiments and variants thereof, and further advantages of the invention will become appreciated and understood by those skilled in the art from the detailed description and drawings following hereinbelow.

MODE(S) FOR CARRYING OUT THE INVENTION

The example proposes a method of setting a cement plug in a wellbore such that the dense cement is supported above a less dense drilling fluid until the cement has set.

In an initial step, the drilling fluid 10 is conditioned as for conventional plug cementing. That is, it is circulated and its Theological properties are adjusted to allow the subsequently injected fluids to easily displace the drilling fluid.

Figure 1A:
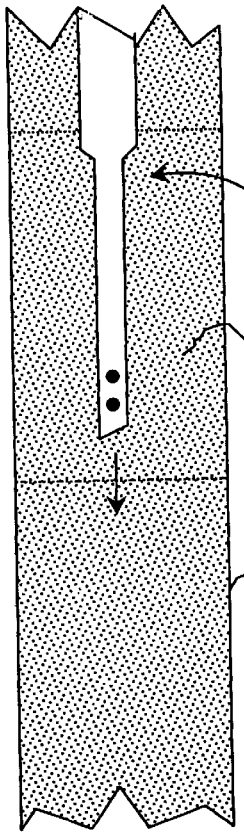
FIGS. 1A–D schematically illustrate the placement of a plug in accordance with the invention FIGS. 2A–C (Prior art) illustrate examples of tools to be used in accordance with the present invention.

FIG. 1A shows the positioning of the placement pipe 11 at an appropriate depth in the wellbore 12. In the figures, two specific depths have been labelled as bottom-of-cement (BOC) and top-of-cement (TOC) respectively. The first position of the placement pipe is located below the BOC position which ideally is upper boundary for the fluid pill to be injected.

Examples of the placement pipe are illustrated by FIGS. 2A–C. As an intensive shear force suitable for triggering the gellation reaction is readily generated by restricting and/or diverting the flow path, a broad variety of designs are feasible. A simple placement pipe is made be using a tubular 20 of reduced diameter as shown in FIG. 2A. A second example, illustrated by FIG. 2B, is known as cement stinger 21. The stinger is a pipe closed at the bottom with openings 211 cut into its side wall. A third example, shown in FIG. 2C, is a specifically adapted sub 23 with a number of nozzles 231. In addition to providing a shear force, the nozzles can be designed to give the fluid flow a preferential direction. The present example assumes the use of a cement stinger as placement pipe.

Both the fluid pill 13 and the cement 14 may be placed by any of the currently known procedures for placing a plug of cement in a wellbore given only that the volumetric flowrate of the rheotropic fluid during placement must be sufficient to initiate the gellation reaction as it passes through the flow restriction in the placement pipe. Typical procedures are (i) the balanced plug method, whereby after displacement the interfaces between different fluids inside and outside the placement pipe are at the same level (ii) the two plug method, that is two rubber plugs are used to separate different fluids during displacement down the placement pipe, or (iii) the pump and pull method where the placement pipe is slowly withdrawn from the wellbore during placement so that the injected material is left behind. The placement may be carried out through drill pipe or coiled tubing.

In addition, appropriate spacer fluids 15 such as water, polymer containing aqueous solutions, or the like may be used to separate the fluid pill 13, the plug material 14 and/or the drilling mud 10.

Figure 1B:
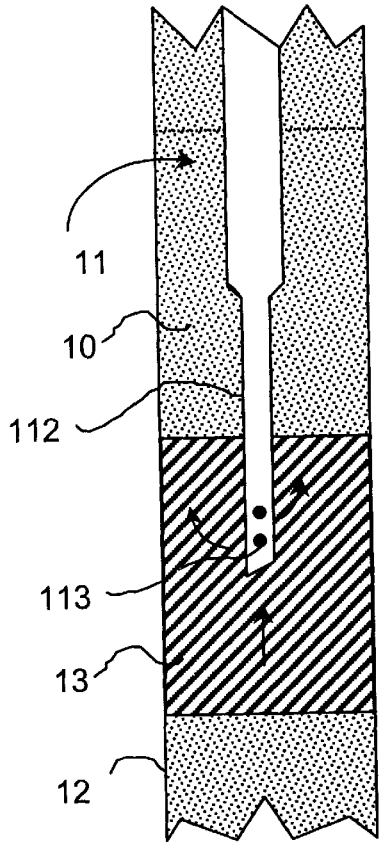
Figure 1C:
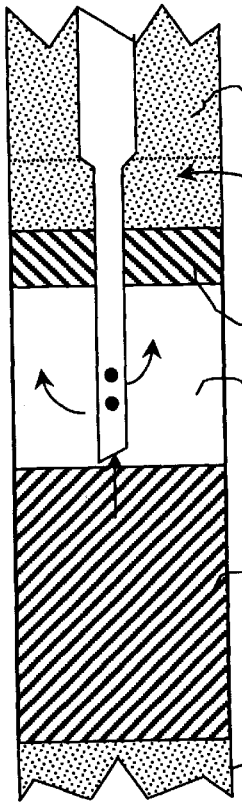
Figure 1D:
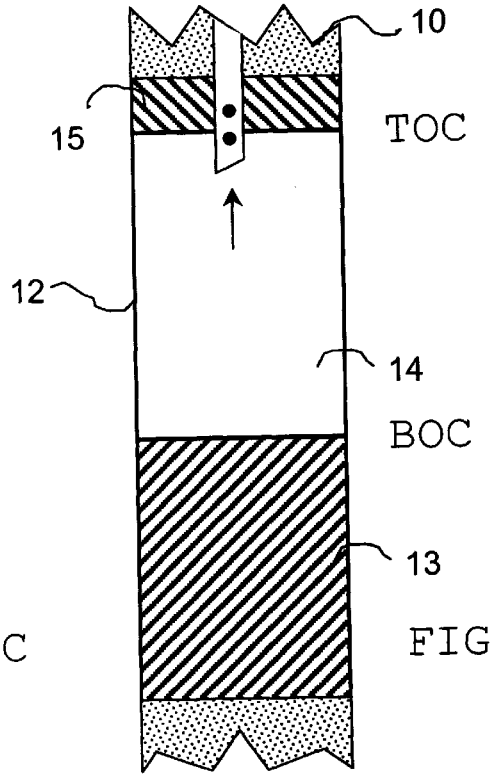

Referring now to FIG. 1B, a quantity of a fluid 13 which reacts to form a strong gel after being subjected to high shear is injected. The stinger 112 has openings 113 to provide the high shear necessary to initiate the gellation reaction in the fluid pill. After injection of the fluid pill 13, the placement pipe 10 is pulled up in the wellbore to a position (BOC) just above the plug of fluid formed in the wellbore. The injected fluid 13 is then allowed to set.

After setting of the injected fluid, cement 14 is injected above the first material 13 which now acts as a support for the cement and prevents it from channelling through into the drilling fluid 10 below. As the cement 14 reaches the predetermined TOC, injection is stopped, the pipe is moved clear and the plug is allowed to set. Again, it should be noted that the described process is simplified in order to clarify the scope of the present invention. In practice, it may prove to be difficult to exactly place the plug according to the predetermined specifications. It is usual practice to apply generous safety margins as to the setting times, volume of the fluid pill and other parameters.

In one preferred embodiment of the invention the fluid pill 13 consists of an emulsion such as disclosed in the International Patent Application WO 94/28085 comprising (i) an oil phase containing an emulsifier and a crosslinking agent for a polysaccharide, and (ii) a water phase containing a polysaccharide. A weighting agent may be added to adjust the density of the fluid. The pill material has the characteristic of remaining liquid until it is subjected to high shear at a flow restriction in the placement device at which time the emulsion comprising the pill is broken and the polysaccharide and the crosslinking agent are brought into contact. After shear the pill undergoes gellation so that it forms a strong platform capable of supporting the cement plug which is placed above it.

In a laboratory experiment the proposed technique proved capable of supporting a conventional class G cement of specific gravity, SG=1.9 above a drilling fluid of SG=1.0. This is the largest density difference that it is common to encounter in plug cementing. The experimental apparatus consisted of a vertical perspex tube 2 inches in diameter which was initially filled with the drilling fluid, a solution of 4 g/l Xanthan gum in fresh water. A fluid pill was mixed consisting of: (1) For the oil phase—175 ml light mineral oil, 0.5 g of commercially available surfactant (EMUL HT available from Schlumberger Dowell), 3 g Bentonite and 2.5 g lime. (2) For the water phase—375 ml of a solution of 8 g/l Xanthan in water and 60 g Barite. This was mixed under relatively low shear conditions using a paddle mixer, resulting in a fluid of SG=1.03, equal to the density of the drilling fluid initially filling the pipe.

The pill material was sheared at a pressure drop of 600 psi (4.137 MPa) and then injected into the test section through an open ended steel pipe with 1 inch (2.5 cm) diameter. The steel pipe was pulled up during placement to leave a region of the perspex pipe approximately 12 inches (30.5 cm) in length full of the pill material. More Xanthan solution was then injected to clean the steel pipe and the pill was afterwards allowed to set undisturbed for 40 min. After this time cement was injected through the steel pipe at a position just above the set material and the placement pipe was withdrawn. The cement remained in position, supported by the set material below for several hours with no observable motion. This was in contrast to the corresponding experiment conducted without the special pill material in which the cement rapidly fell through the 4 g/l Xanthan solution to rest on the bottom of the model in a matter of seconds.

What is claimed is:

1. Method of placing a plug in a wellbore traversing subterranean formations comprising the step of injecting, prior to the injection of plug material, a chemical compound to support said plug material during a setting time period, wherein at least partial solidification of said chemical compound can be initiated by shear forces.

2. The method of claim 1, further comprising the steps of determining a desired location for the plug;

injecting a predetermined amount of the chemical compound such that the solidification of said compound occurs at a location close to the bottom end of said desired location;

delaying injection of the plug material until the injected chemical compound has the strength to support said plug material;

injecting said plug material.

3. The method of claim 1, wherein the chemical compound is an emulsion which destabilises under shear forces and after destabilisation solidifies.

4. The method of claim 1, wherein the chemical compound is an emulsion containing polymers and crosslinking agents separated by phase boundaries before applying shear forces.

5. The method of claim 1, wherein the chemical compound provides after setting a supportive strength of more than 500 Pa.

* * * * *